US008091349B2

(12) United States Patent
Sakurai et al.

(10) Patent No.: US 8,091,349 B2
(45) Date of Patent: Jan. 10, 2012

(54) MOTORCYCLE

(75) Inventors: Motoki Sakurai, Shizuoka (JP); Tomonao Nakayama, Shizuoka (JP); Yoshihito Ooyama, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 1008 days.

(21) Appl. No.: 11/765,327

(22) Filed: Jun. 19, 2007

(65) Prior Publication Data

US 2007/0295002 A1 Dec. 27, 2007

(30) Foreign Application Priority Data

Jun. 23, 2006 (JP) ..... 2006-174484
Oct. 24, 2006 (JP) ..... 2006-288798

(51) Int. Cl.
*F01N 3/00* (2006.01)
*F01N 3/10* (2006.01)
*F01N 1/00* (2006.01)
*F02B 27/02* (2006.01)

(52) U.S. Cl. ..... 60/299; 60/289; 60/293; 60/314; 60/324

(58) Field of Classification Search ..... 60/299, 60/289, 293, 314, 324
See application file for complete search history.

(56) References Cited

U.S. PATENT DOCUMENTS 5,785,014 A * 7/1998 Cornwell ..... 123/65 PE
7,347,045 B2 * 3/2008 Bozmoski et al. ..... 60/312
2003/0005688 A1 * 1/2003 Bassani ..... 60/313

FOREIGN PATENT DOCUMENTS

JP 08-246861 9/1996

* cited by examiner

*Primary Examiner* — Thomas Denion
*Assistant Examiner* — Michael Carton
(74) *Attorney, Agent, or Firm* — Rabin & Berdo, PC

(57) ABSTRACT

A silencer for a motorcycle with relaxed layout restrictions has a drum portion connected to a head. A conduit extends through the drum portion in a direction of connection. The drum portion decreases in cross sectional area toward a downstream side. A catalyst holding portion formed in the head has a catalyst fixed member to which a catalyst inserted member is fixed at a position upstream of the drum portion. A catalyst is inserted into the catalyst inserted member.

21 Claims, 4 Drawing Sheets

[Fig. 1]
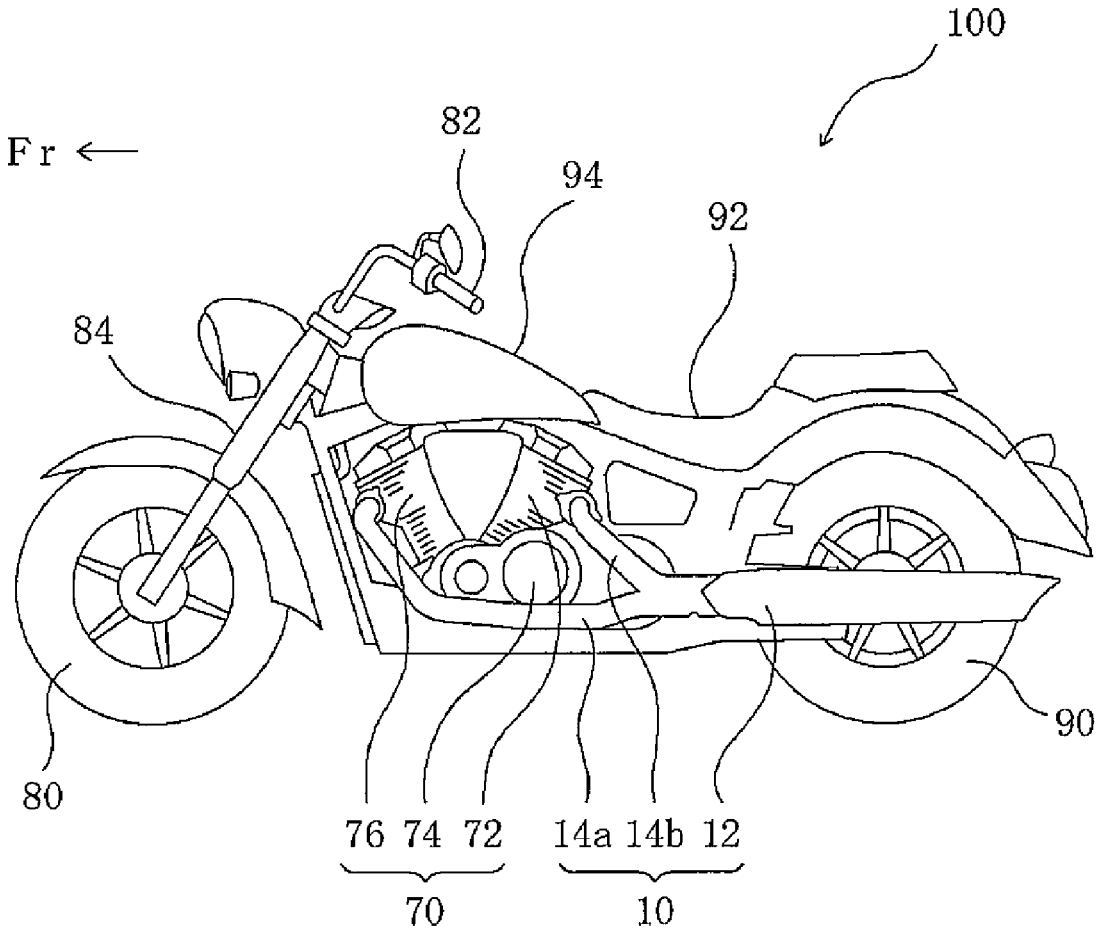

[Fig. 2]
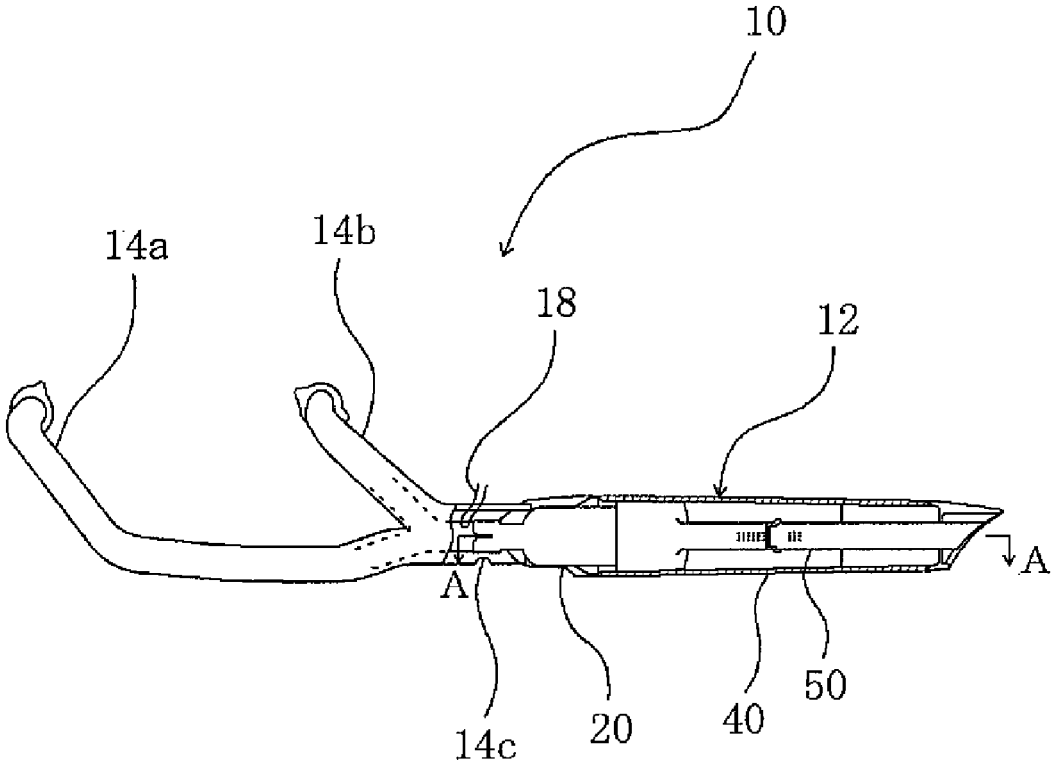

[Fig. 3]
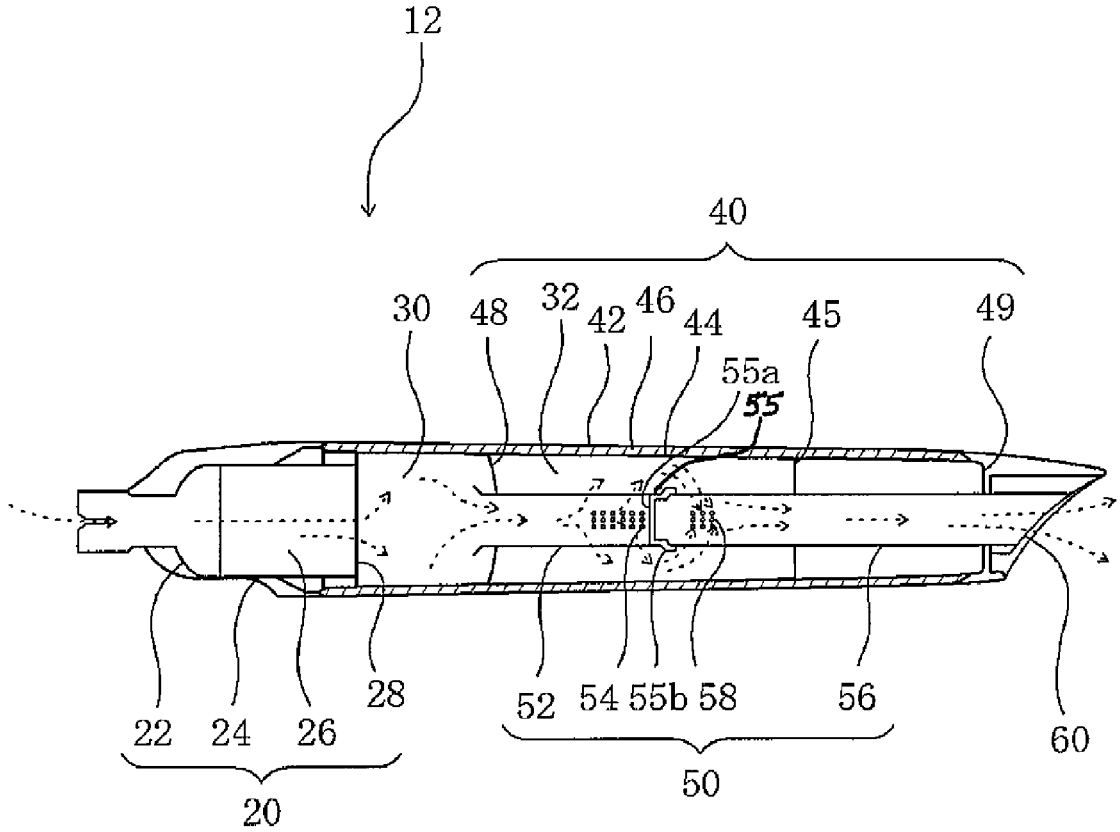

[Fig. 4]
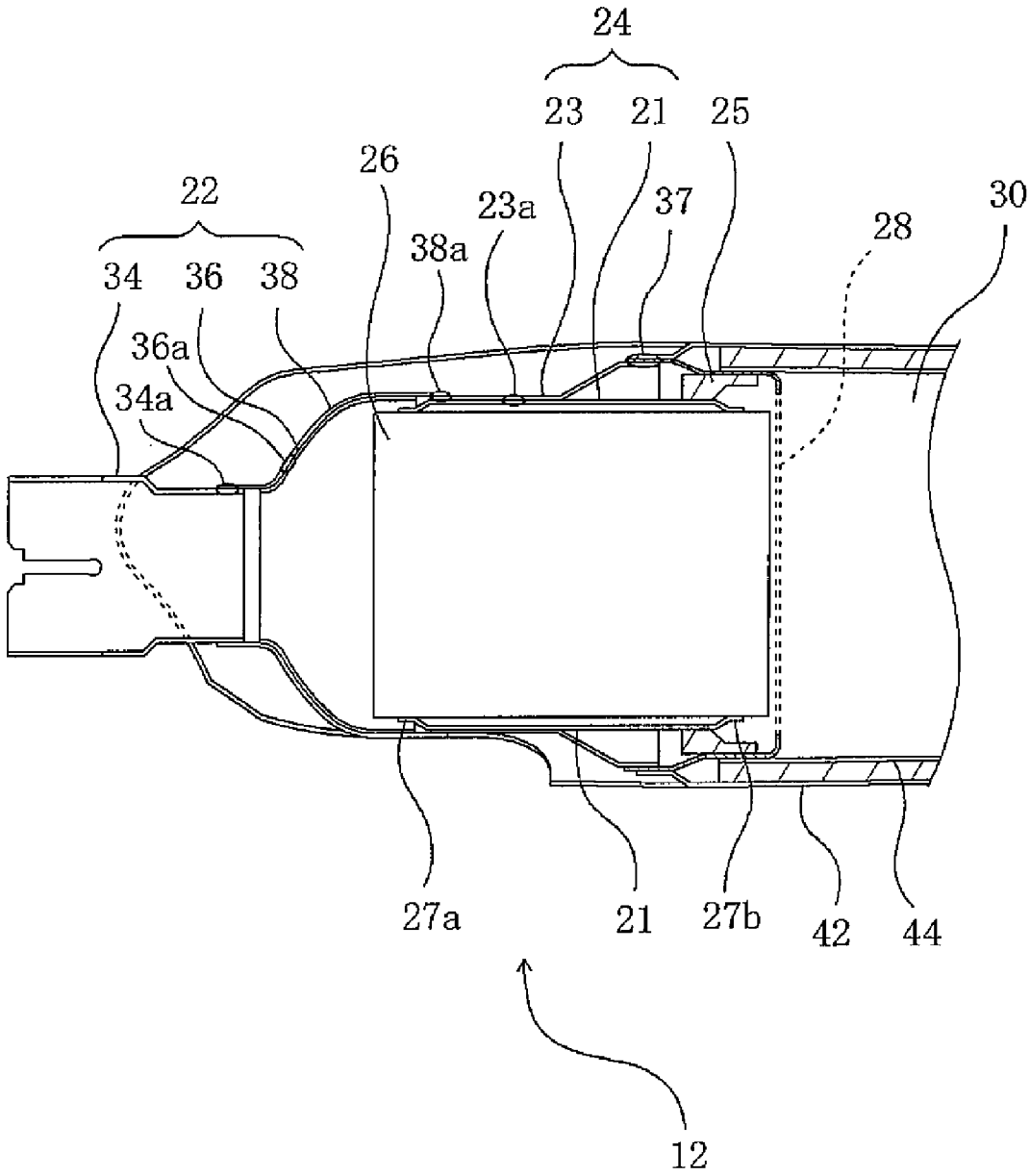

MOTORCYCLE

RELATED APPLICATIONS

This application claims the benefit of priority under 35 USC 119 of Japanese patent application no. 2006-174484, filed on Jun. 23, 2006, and Japanese patent application no. 2006-288798, filed on Oct. 24, 2006, which applications are hereby incorporated by reference in their entireties.

BACKGROUND OF THE INVENTION

1. Field of the Invention

The present invention relates to a silencer and a motorcycle provided with the silencer.

2. Description of Related Art

Some motorcycles comprise an exhaust emission control device, in which a catalyst is mounted in an exhaust silencer and exhaust gases from an engine are purified by contacting the catalyst when passing through the exhaust silencer. JP-A-8-246861, for example, proposes a construction for mounting a catalyst in an exhaust silencer.

JP-A-8-246861 discloses a catalyst mount construction in which an exhaust silencer (silencer) is double-tube structured to include an inner cylinder and an outer cylinder. A catalyst fixed member is provided on an inner peripheral surface of the inner cylinder, a catalyst fixed flange is provided on an outer peripheral surface of a catalyst, and the catalyst is mounted in the exhaust silencer by fixing the catalyst fixed flange to the catalyst fixed member by means of a bolt.

Since the catalyst is fixed to the inner peripheral surface of the inner cylinder in the construction disclosed in JP-A-8-246861, however, the inner cylinder is preferably a straight tube (in the form of a straight cylinder) in order to firmly fix the catalyst, and a shape of the outer cylinder is also determined to some degree according to a shape of the inner cylinder when the inner cylinder is made a straight tube, so that the whole silencer is considerably restricted in freedom of design.

Many large-sized motorcycles, which have a low-speed type V-type engine, have two silencers. If the number of silencers is reduced to one (in view of weight, for example), a decrease in exhaust efficiency results. To increase exhaust efficiency, the silencer diameter may be increased. Thus, in a large-sized motorcycle having a low-speed type engine and a single silencer, the silencer must be large in diameter, which further aggravates restrictions on the layout of the silencer.

SUMMARY OF THE INVENTION

The invention has been thought of in view of these issues and provides a silencer in which restrictions in layout are relaxed.

The invention provides a silencer comprising a head and a drum portion connected to the head. The drum portion decreases in cross-sectional area toward a downstream side. A conduit extends through the drum portion in a direction of connection. A catalyst holding portion is formed in the head. The catalyst holding portion comprises a catalyst fixed member and a catalyst inserted member fixed to the catalyst fixed member at a position upstream of the drum portion. A catalyst is inserted into the catalyst inserted member.

In one embodiment, an exhaust gas restricting member is interposed between the catalyst inserted member and the drum portion to restrict the flow of exhaust gases between the catalyst inserted member and the drum portion.

In one embodiment, the drum portion comprises an inner cylinder received in an outer cylinder, and a sound absorbing material filled between the outer and inner cylinders.

In one embodiment, the conduit comprises conduit upstream and downstream portions with a partition plate therebetween. Exhaust gases outflow through a plurality of holes formed in the conduit upstream portion and inflow through a plurality of holes formed in the conduit downstream portion.

In one embodiment, the partition plate comprises a bottom portion fit into an inner periphery of the conduit upstream portion, and a tubular portion fit onto an outer periphery of the conduit downstream portion.

A silencer according to the invention constructed as described above, advantageously has relaxed restrictions in layout.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is a side view of a motorcycle according to the invention.

FIG. 2 is a partial sectional view of a muffler according to the invention.

FIG. 3 is a cross-sectional view of a silencer according to the invention taken along line A-A of FIG. 2.

FIG. 4 is an enlarged cross-sectional view of a mount portion of a catalyst in the silencer of FIG. 3.

DETAILED DESCRIPTION OF THE INVENTION

An embodiment of the invention is now described with reference to the drawings. In the drawings, members and portions having substantially the same function are denoted by the same reference numerals for simplicity of description. The invention is not limited to the following embodiment.

A motorcycle 100 according to one embodiment of the invention is illustrated in FIG. 1. Motorcycle 100 is a large-sized motorcycle, on which a low-speed type V-type engine is mounted as a prime mover, comprising a seat 92, a handle 82, an engine 70, a front wheel 80, a rear wheel 90 and a muffler 10.

Seat 92 is arranged rearwardly in a longitudinal direction of motorcycle 10, and handle 82 is arranged forwardly of seat 92. A steering shaft 84 extending forwardly and downwardly of handle 82 supports front wheel 80. A rider seated on seat 92 manipulates handle 82, and the manipulating force is transmitted to front wheel 80 through steering shaft 84. A traveling direction of motorcycle 100 is determined by changing an orientation of front wheel 80.

A fuel tank 94 is mounted forwardly of seat 92 and an engine 70 is mounted below fuel tank 94. Engine 70, in one embodiment, is a so-called V-type two-cylinder four-stroke engine, on which cylinders are arranged in a V-shaped configuration as viewed from laterally such that a front cylinder head 72*a* and a rear cylinder head 72*b* are distributed from a crank case 74 in the longitudinal direction of motorcycle 100.

Fuel flowing out from fuel tank 94 passes through an injector (not shown) to mix with air and then is taken into the cylinders through intake ports (not shown) provided on front cylinder head 72*a* and rear cylinder head 72*b*. The fuel is burned to cause engine 70 to generate power. Power generated from engine 70 is transmitted through a drive shaft (not shown) to drive rear wheel 90.

Exhaust gases are discharged from engine 70 through a muffler 10 that regulates exhaust noise. Muffler 10 comprises a cylindrical-shaped member extending in the longitudinal direction of motorcycle 10. Muffler 10 includes a front exhaust pipe 14*a* and a rear exhaust pipe 14*b*, which are connected to engine 70, and a silencer 12 connected to front exhaust pipe 14*a* and rear exhaust pipe 14*b*. While large-sized motorcycles with a low-speed type V-type engine mounted thereon adopt two mufflers in many cases, motorcycle 100 according to the embodiment adopts a single muffler in view of cost.

As shown in FIG. 2, front exhaust pipe 14*a*, rear exhaust pipe 14*b* and silencer 12 of muffler 10 are formed as a member that is mounted to motorcycle 10.

Front exhaust pipe 14*a* and rear exhaust pipe 14*b* are coupled to an exhaust hole of engine 70 to lead exhaust gases from engine 70 to silencer 12. In particular, upstream ends of front exhaust pipe 14*a* and rear exhaust pipe 14*b* are connected to exhaust ports (not shown) of front cylinder head 72*a* and rear cylinder head 72*b*. Downstream portions of front and rear exhaust pipes 14*a* and 14*b* combine forwardly of an upstream end of silencer 12 to form an exhaust-pipe downstream end 14*c* (exhaust chamber).

An $O_2$ sensor 18 (oxygen sensing device) for detection of oxygen is mounted to exhaust-pipe downstream end 14*c*. $O_2$ sensor 18 serves to regulate a mixing ratio in exhaust gases introduced into silencer 12 to promote a catalytic reaction in silencer 12.

Exhaust gases from engine 70 pass through front and rear exhaust pipes 14*a* and 14*b* from respective combustion chambers of front and rear cylinder heads 72*a* and 72*b* to merge at exhaust-pipe downstream end 14*c*, and then are led into silencer 12. Silencer 12 has a noise reducing function and discharges exhaust gases led from front and rear exhaust pipes 14*a* and 14*b* to the outside.

The internal construction of silencer 12 and the path along which exhaust gases introduced into silencer 12 flow out is illustrated in FIG. 3. As shown in FIG. 3, silencer 12 comprises a head 20. A catalyst 26 to prevent dispersion of toxic substances contained in exhaust gases is mounted to head 20. A drum portion 40 is connected to a downstream end of head 20. Two expansion chambers 30, 32 are provided in drum portion 40. A single conduit 50 extends longitudinally through substantially the whole drum portion 40.

Head 20 comprises a tapered exhaust pipe connecting portion 22 connected to exhaust-pipe downstream end 14*c*. The inside diameter of connecting portion 22 increases downstream from the connection to the exhaust pipe. A cylindrical-shaped catalyst holding portion 24 is contiguous to a downstream side of exhaust pipe connecting portion 22. A partition 28 is provided at a downstream end of catalyst holding portion 24. Partition 28 is a disk-shaped member welded to an inner cylinder 44 of drum portion 40. Alternatively, partition 28 may be mounted to inner cylinder 44 by means of press fitting.

Catalyst 26 is provided in catalyst holding portion 24 to subject exhaust gases to a catalytic reaction. Catalyst holding portion 24 comprises a catalyst inserted member 21 (FIG. 4) into which catalyst 26 is inserted, and a catalyst fixed member 23 (FIG. 4), to which catalyst inserted member 21 is fixed. A method of holding catalyst 26 on catalyst holding portion 24 is described below in detail.

Catalyst 26 is a material capable of purifying exhaust gases. In one embodiment, catalyst 26 is a so-called ternary catalyst formed by coating metal such as platinum, rhodium, etc. on a surface of a honeycomb-shaped part made of ceramic and stainless steel.

Drum portion 40 is a cylindrical-shaped portion formed to be tapered and has a double tube structure composed of an inner cylinder 44 received in an outer cylinder 42. Both outer cylinder 42 and inner cylinder 44 are tapered to decrease in diameter toward a downstream side.

The drum portion of a silencer is liable to draw observer's eyes and thus should have a favorable design. In this regard, drum portion 40 is tapered so as to give a sharp impression even when silencer 12 is large in diameter. However, the cross sectional shape of drum portion 40 is not limited to a circular or cylindrical shape but may be otherwise (for example, oval, elliptic, polygonal, etc.). While a cylinder shaped to be tapered decreases in diameter toward a downstream side from an upstream side, it decreases in cross sectional area when a cross sectional shape thereof is other than a circular shape.

A longitudinally intermediate portion of drum portion 40 is provided with a disk-shaped partition 48, which shuts off flow of exhaust gases in a longitudinal direction within drum portion 40. First expansion chamber 30 is provided upstream of partition 48. Upstream and downstream ends of chamber 30 are closed by partition 48 and catalyst fixed member 23.

Second expansion chamber 32 is provided downstream of partition 48. A disk-shaped lid portion 49 is mounted to a downstream end of drum portion 40, that is, to downstream ends of outer cylinder 42 and inner cylinder 44, to close a downstream end of second expansion chamber 32. Lid portion 49 may be mounted to the downstream end of drum portion 40 by welding or press fitting.

At least a portion of inner cylinder 44 is formed with a plurality of small holes to permit energy of exhaust gases introduced from exhaust pipe 14 to pass through to outer cylinder 42. A sound absorbing material 46 is filled between an inner wall of outer cylinder 42 and an outer wall of inner cylinder 44. Sound absorbing material 46 is exposed into second expansion chamber 32 from the holes.

Sound absorbing material 46 may be, for example, glass wool, stainless steel wool (SUS wool), aluminum wool, ferrite, etc. In one embodiment, glass wool is used. In another embodiment, SUS wool is provided on the outer wall of inner cylinder 44 and glass wool is provided between an outer periphery thereof and the inner wall of outer cylinder 42.

Conduit 50 extends straight through a diametrically central portion of drum portion 40 in a direction of connection and extends straight in second expansion chamber 32. An upstream end of conduit 50 extends through partition 48 in drum portion 40 to be opened into first expansion chamber 30. A downstream end of conduit 50 extends through lid portion 49 of drum portion 40 to be opened to outside air outside second expansion chamber 32.

The longitudinally intermediate portion of conduit 50, which is arranged in second expansion chamber 32, is provided with a partition plate 55 that shuts off flow of exhaust gases in a longitudinal direction within conduit 50. Conduit 50 is separated into a conduit upstream portion 52 and a conduit downstream portion 56 with partition plate 55 as a boundary.

A portion of conduit upstream portion 52 adjacent to partition plate 55 is formed with a plurality of outflow holes 54. Outflow holes 54 permit exhaust gases, introduced into conduit upstream portion 52 from first expansion chamber 30, to flow into second expansion chamber 32.

A portion of conduit downstream portion 56 adjacent to partition plate 55 is formed with a plurality of inflow holes 58. Inflow holes 58 permit exhaust gases, which pass from conduit upstream portion 52 through outflow holes 54 to flow into second expansion chamber 32, to flow into conduit downstream portion 56.

That is, partition plate 55 is provided in conduit 50 between outflow holes 54 and inflow holes 58 within second expansion chamber 32. Outflow holes 54 and inflow holes 58 are circular-shaped, equal in diameter, and are arranged regularly on respective sides of conduit upstream portion 52 and conduit downstream portion 56 with predetermined intervals in longitudinal and circumferential directions of conduit 50.

Partition plate 55, according to one embodiment, is made of stainless steel and cylindrical-shaped to be bottomed, and comprises a bottom portion 55*a* having an outside diameter corresponding to an inner periphery of the conduit upstream portion and a tubular portion 55*b* having an inside diameter corresponding to an outer periphery of the conduit downstream portion.

Bottom portion 55*a* of partition plate 55 is fitted into a downstream end of conduit upstream portion 52, and an upstream end of conduit downstream portion 56 is fitted into tubular portion 55*b* of partition plate 55, whereby conduit upstream portion 52 and downstream portion 56 are connected and partitioned therebetween. That is, partition plate 55 serves both to partition between and connect conduit upstream portion 52 and downstream portion 56.

When a disk-shaped member is used to partition between conduit upstream portion 52 and downstream portion 56, a clearance is generated between an inner peripheral surface of conduit 50 and an outer peripheral surface of the disk, and exhaust gases flow directly into conduit downstream portion 56 through the clearance, which adversely influences sound damping characteristics With the inventive structure of partition plate 55, however, exhaust gases in conduit upstream portion 52 surely flow once into second expansion chamber 32 through outflow holes 54 and then flow into conduit downstream portion 56 through inflow holes 58, so that sound damping characteristics are favorably maintained.

As described, bottom portion 55*a* of partition plate 55 is fitted into conduit upstream portion 52 and conduit downstream portion 56 is fitted into tubular portion 55*b* of partition plate 55. However, a reverse construction will do. That is, bottom portion 55*a* of partition plate 55 may be fitted into conduit downstream portion 56 and conduit upstream portion 52 may be fitted into bottom portion 55*b* of partition plate 55. This reverse construction also prevents exhaust gases from flowing directly into conduit downstream portion 56 from upstream portion 52.

An inner peripheral surface of drum portion 40 (an inner peripheral surface of inner cylinder 44) is provided with a reinforcement member 45 that reinforces drum portion 40 diametrically. In one embodiment, reinforcement member 45 is a disk-shaped member made of stainless steel.

The flow path of exhaust gases introduced into silencer 12 is shown by arrows in FIG. 3. Exhaust gases in exhaust-pipe downstream end 14*c* flow into exhaust pipe connecting portion 22 of head 20 of silencer 12. The exhaust gases then pass through catalyst holding portion 24 and are purified by catalytic reaction with catalyst 26. The purified exhaust gases outflow into first expansion chamber 30 to expand once.

Exhaust gases having expanded in first expansion chamber 30 flow into upstream portion 52 of conduit 50 that is opened to partition 48. The upstream end of conduit 50 is not shielded by any partition or the like, and exhaust gases having expanded in first expansion chamber 30 are smoothly led into conduit 50, thereby reducing inflow resistance and improving exhaust efficiency.

Exhaust gases flowing through conduit upstream portion 52 are shut off by partition plate 55 and flow outside conduit 50 through outflow holes 54 and into second expansion chamber 32. Having expanded in second expansion chamber 32, exhaust gases flow into conduit downstream portion 56 through inflow holes 58. Exhaust gases are finally discharged to the atmosphere from an opening at a downstream end of a tail portion 60 of conduit 50.

A structure for holding and assembling catalyst 26 is shown in FIG. 4. As described above, catalyst holding portion 24, which holds catalyst 26, comprises a catalyst inserted member 21, into which catalyst 26 is inserted, and a catalyst fixed member 23, to which catalyst inserted member 21 is fixed. An exhaust gas restricting member 25 is interposed between catalyst inserted member 21 and drum portion 40 partition 28 in the example as shown).

Catalyst inserted member 21 is a cylindrical-shaped member made of stainless steel having a thermal resistance to the catalytic reaction. In one embodiment, catalyst inserted member 21 has a two-point holding structure, in which a catalyst is held by stays in two locations within catalyst inserted member 21. Stays 27*a* and 27*b* bent diametrically inward and decreased in diameter are provided, respectively, on upstream and downstream ends of catalyst inserted member 21 to hold catalyst 26 in two locations.

One of stays 27*a* and 27*b* is not fixedly welded to catalyst 26 but is press-fitted slidably thereinto. In one embodiment, catalyst 26 is fixedly welded to stay 27*b* on a downstream side and press-fitted into stay 27*a* on an upstream side to be held in a caulked state.

In this manner, since catalyst 26 is fixedly welded in one held location and press-fitted in the other held location, even where a large thermal stress is generated by thermal expansion of catalyst 26, catalyst 26 is able to slide to release the thermal stress, thereby preventing breakage and deformation of catalyst 26.

Catalyst fixed member 23, to which catalyst inserted member 21 is fixed, is made of steel sheet, one side of which is subjected to Ni plating treatment. Catalyst fixed member 23 is formed on a diametrically outermost side of catalyst holding portion 24 to form an outline of catalyst holding portion 24.

Catalyst inserted member 21 is fitted into catalyst fixed member 23 and fixedly welded thereto at a weld 23*a* positioned on an upstream side of catalyst fixed member 23. That is, catalyst 26 is fixed indirectly to catalyst fixed member 23 through catalyst inserted member 21.

According to the invention, since catalyst inserted member 21, into which catalyst 26 is inserted, is fixed to catalyst fixed member 23 in a position (weld 23*a* in the example as shown) upstream of drum portion 40, layout restrictions on drum portion 40 of silencer 12 are relaxed.

In other words, since catalyst 26 is not fixed to the inner peripheral surface of inner cylinder 44 of drum portion 40, but instead is fixed indirectly to catalyst fixed member 23 positioned upstream of inner cylinder 44, it is permissible to shape inner cylinder 44 of the double tube otherwise a straight tube. Accordingly, it is possible to relax restrictions in layout on silencer 12.

In particular, since restrictions of making a silencer large in diameter are imposed on large-sized motorcycles with a low-speed type V-type engine mounted, in which the number of silencers is one, further restrictions in layout are relaxed. For example, even though the silencer is large in diameter, a sharp impression is given to an observer by forming a double tube in a tapered manner.

In addition, while catalyst inserted member 21 and catalyst fixed member 23 are welded together according to the embodiment, other means of fixation can be used, so long as catalyst inserted member 21 and fixed member 23 are fixed together at a location upstream of drum portion 40. For example, catalyst inserted member 21 and catalyst fixed member 23 may be fixed together by means of a bolt.

A downstream side of catalyst fixed member 23 is bent radially outward to be increased in diameter and welded at a weld 37 to partition 28. Catalyst holding portion 24 is sealed by the bent structure of catalyst fixed member 23.

Exhaust gas restricting member 25 is interposed between catalyst inserted member 21 and partition 28 to restrict flow of exhaust gases between catalyst inserted member 21 and partition 28. In one embodiment, exhaust gas restricting member 25 is a molded member, into which stainless steel wire worked in the form of a thin thread and fiber are woven, that is fixed to an inner peripheral surface of partition 28 by means of welding.

Exhaust gas restricting member 25 inhibits high temperature exhaust gases from going between catalyst inserted member 21 and partition 28, thereby preventing the exhaust gases from raising catalyst fixed member 23 in surface temperature and preventing discoloring of plating.

Assembly of catalyst 26 is completed by first assembling exhaust pipe connecting portion 22, then assembling catalyst holding portion 24, then connecting exhaust pipe connecting portion 22 and catalyst holding portion 24 together by means of welding, and finally connecting catalyst holding portion 24 and drum portion 40 of silencer 12 together by means of welding. A further detailed explanation is given below.

Exhaust pipe connecting portion 22 comprises a connecting member 34 connected to exhaust-pipe downstream end 14*c*, a tapered member 38 connected to connecting member 34, and an inner shaped member 36, which covers a diametrical inside of tapered member 38. When catalyst 26 is to be assembled, connecting member 34 and tapered member 38 are fixedly welded together at a weld 34*a*, then inner shaped member 36 and tapered member 38 are fixedly welded together at a weld 36*a*, and an exhaust pipe connecting portion intermediate product, in which constituent members of exhaust pipe connecting portion 22 are assembled integrally, is prepared.

Next, after catalyst 26 is inserted into catalyst inserted member 21 and a clearance between stays 27*a*, 27*b* and catalyst 26 is removed by radially applying pressure to such an extent that catalyst 26 is not broken, stay 27*b* on a downstream side and catalyst 26 are fixed together by means of welding. Catalyst inserted member 21, to which catalyst 26 is fixed, is then inserted into catalyst fixed member 23, and an outer peripheral surface of catalyst inserted member 21 and an inner peripheral surface of catalyst fixed member 23 are fixed together at weld 23*a* by means of welding.

Next, an upstream end of catalyst fixed member 23 is inserted into a downstream side of the exhaust pipe connecting portion intermediate product as beforehand assembled integrally, and a downstream end of tapered member 38 and the upstream end of catalyst fixed member 23 are fixed together by means of welding. Thereby, connection of exhaust pipe connecting portion 22 and catalyst holding portion 24 is completed.

Thereafter, partition 28 is arranged in opposition to a downstream end of catalyst 26, and an upstream end of partition 28 and an upstream end of outer cylinder 42 of drum portion 40 are caused to overlap each other. A downstream side of catalyst fixed member 23 is arranged radially inwardly of an upstream end of partition 28. Finally, a downstream end of catalyst fixed member 23, the upstream end of partition 28, and the upstream end of outer cylinder 42 are fixed by performing three-point welding at weld 37. Thereby, connection of catalyst holding portion 24 and drum portion 40 is completed. Catalyst 26 is assembled in this order in silencer 12.

While the invention has been described by way of particular embodiments, such descriptions are not limitative. Various modifications thereto will be apparent to those of skill in the art, and such modifications are within the scope of the invention as defined by the following claims.

The invention claimed is:

1. A silencer comprising:
- a head;
- a drum portion connected to the head and decreasing in cross-sectional area toward a downstream side;
- a conduit extending through the drum portion in a direction of connection;
- a catalyst holding portion formed in the head and comprising:
  - a catalyst fixed member; and
  - a catalyst inserted member fixed to the catalyst fixed member at a position upstream of the drum portion; and
- a catalyst inserted into the catalyst inserted member;
- wherein at least a portion of the catalyst is spaced apart from the catalyst fixed member and catalyst inserted member.

2. The silencer according to claim 1, wherein the head comprises:
- a tapered exhaust pipe connection portion configured for connection to a exhaust pipe downstream end;
- the catalyst holding portion connected to a downstream end of the exhaust pipe connection portion; and
- a partition connected to the drum portion.

3. The silencer according to claim 2, wherein an inside diameter of the exhaust pipe connection portion increases downstream from the connection to the exhaust pipe downstream end.

4. The silencer according to claim 2, wherein the partition comprises at least one of a welded or a press-fitted connection to the drum portion.

5. The silencer according to claim 1, and further comprising:
- an exhaust gas restricting member interposed between the catalyst inserted member and the drum portion that restricts flow of exhaust gases between the catalyst inserted member and the drum portion.

6. The silencer according to claim 1, wherein the drum portion comprises:
- an outer cylinder;
- an inner cylinder received in the outer cylinder; and
- a sound absorbing material filled between the outer cylinder and the inner cylinder.

7. The silencer according to claim 1, wherein the conduit comprises:
- a conduit upstream portion formed with a plurality of outflow holes through which exhaust gases outflow;
- a conduit downstream portion formed with a plurality of inflow holes through which exhaust gases inflow; and
- a partition plate that partitions the conduit upstream portion and the conduit downstream portion.

8. The silencer according to claim 7, wherein the partition plate comprises:
- a bottom portion fitted into an inner periphery of the conduit upstream portion; and
- a tubular portion fitted onto an outer periphery of the conduit downstream portion.

9. The silencer according to claim 7, and further comprising:
- a disk-shaped partition formed in a longitudinally intermediate portion of the drum portion; and a first expansion chamber is defined between the disk-shaped partition and the head.

10. The silencer according to claim 9, and further comprising:

a disk-shaped lid portion mounted to a downstream end of the drum portion; and a second expansion chamber defined between the disk-shaped partition and the disk-shaped lid portion.

11. The silencer according to claim 10, wherein:

an upstream end of the conduit extends through the disk-shaped partition and into the first expansion chamber; and a downstream end of the conduit extends through the disk-shaped lid portion and into outside air.

12. The silencer according to claim 7, wherein the outflow and inflow holes are circular-shaped and equal in diameter.

13. The silencer according to claim 7, wherein the outflow and inflow holes are arranged regularly at predetermined intervals in longitudinal and circumferential directions of the conduit.

14. The silencer according to claim 1, wherein the catalyst inserted member comprises two stays for holding the catalyst.

15. The silencer according to claim 14, wherein one of the two stays comprises a welded connection to the catalyst and another of the two stays comprises a press-fitted connection to the catalyst.

16. A motorcycle comprising the silencer according to claim 1.

17. A method for exhausting gases through a silencer of a motorcycle, comprising:

flowing an exhaust gas from a downstream end of an exhaust pipe into an exhaust pipe connecting portion of a head of the silencer;

flowing the exhaust gas from the exhaust pipe connecting portion into a catalyst holding portion for a catalytic reaction with a catalyst;

flowing the exhaust gas from the catalyst holding portion and into a first expansion chamber of a drum portion connected to the head;

flowing the exhaust gas from the first expansion chamber and into an upstream portion of a conduit within the drum portion;

flowing the exhaust gas through outflow holes formed in the upstream portion of the conduit and into a second expansion chamber of the drum portion;

flowing the exhaust gas from the second expansion chamber into a downstream portion of the conduit through inflow holes formed in the downstream portion of the conduit;

flowing the exhaust gas into the atmosphere through an opening at a downstream end of the conduit; and forming the catalyst holding portion by fixing a catalyst inserted member to a catalyst fixed member at a position upstream of the drum portion.

18. The method according to claim 17, and further comprising:

partitioning the upstream and downstream portions of the conduit with a partition having a bottom portion fitted into an inside periphery of the conduit upstream portion and a tubular portion fitted around an outside periphery of the conduit downstream portion.

19. The method according to claim 17, and further comprising:

holding the catalyst in the catalyst holding member at a first location by welding and at a second location by press-fitting.

20. The silencer according to claim 1, wherein a downstream side of the catalyst fixed member is increased in diameter as compared to an upstream portion of the catalyst fixed member.

21. The silencer according to claim 1, wherein at least a portion of the catalyst inserted member is disposed between the catalyst and the catalyst fixed member.

* * * * *